343-909 SR
8/31/76 XR 3,978,486

United States Patent [19]
Reinders

[11] 3,978,486
[45] Aug. 31, 1976

[54] ANTENNA REFLECTOR SUPPORT

[76] Inventor: Michiël Antonius Reinders, 51 Westergo, Zoetermeer, Netherlands

[22] Filed: Dec. 30, 1974

[21] Appl. No.: 537,403

[30] Foreign Application Priority Data

Jan. 11, 1974 Netherlands ..... 7400413

[52] U.S. Cl. ..... 343/781 EA; 343/840; 343/872; 343/909

[51] Int. Cl.[2] ..... H01Q 19/14

[58] Field of Search ..... 343/837, 838, 840, 872, 343/909, 781

[56] References Cited

UNITED STATES PATENTS

| | | | |
|---|---|---|---|
| 2,045,398 | 6/1936 | Massey et al. | 343/838 |
| 2,645,769 | 7/1953 | Roberts | 343/781 |
| 3,231,892 | 1/1966 | Matson et al. | 343/909 |
| 3,761,937 | 9/1973 | Tricoles et al. | 343/872 |
| 3,787,869 | 1/1974 | Charlton | 343/781 |

OTHER PUBLICATIONS

Oh et al., A Slotted Metal Radome Cap for Rain, Hail, & Lightning Protection, Microwave Journal, 3-68, pp. 105-108.

*Primary Examiner*—Eli Lieberman

[57] ABSTRACT

A slotted hollow cylindrical electrically conductive support for a parabolic micro-wave transmitter antenna reflector coaxial with and surrounding a conical antenna reflector whereby omnidirectional rays of energy from said conical antenna pass from the inside of the cylindrical support radially to the outside of said support, because the slots in the support are of such shape and dimensions that each of these slots can be considered as a radiating element. A non-conducting weather protecting film may surround the cylindrical support.

6 Claims, 3 Drawing Figures

ANTENNA REFLECTOR SUPPORT

BACKGROUND OF THE INVENTION

The invention relates to an antenna reflector support which, in the radiation field, supports the passive parabolic reflector on an omnidirectional antenna for a microwave transmitter and consists in a cylindrical wall coaxial with the reflector.

Originally the parabolic reflector of such an antenna was supported by two or more metal posts. These posts, however, affected the homogeneity of the field, so that the radiation diagram was no longer rotation-symmetrical. In order to overcome this difficulty the posts were replaced by a cylindrical wall of dielectic material.

A reflector support of this type is described in publication A454 TBr 5 of the German Post Office Telecommunications Research Institute, January 1969. Such a dielectric support provides, on the one hand, a sufficient rigidity of the support and, on the other, a protection of the antenna components from the influence of the weather.

However the use of a dielectric material for this support has the drawback that, due to ultra-violet irradiation, it becomes brittle, owing to which its strength decreases, so that frequent maintenance of the usually difficulty accessible antenna is necessary. Moreover, owing to the change of the dielectric properties of the material, the reflection increased, to the detriment of the quality of the antenna.

On the other hand utilization of a wall made of a good conductor for electricity and provided with slots as active elements was known in itself, e.g. from the so-called waveguide slot antennae, in which, however, the wall is the outer conductor of a closed transmission line and, as such, an active current-carrying element. In that case the waves travel lengthwise through the space enclosed by the wall. Moreover, the wall has no supporting function.

SUMMARY OF THE INVENTION

The present invention provides a solution to the above prior art difficulties and problems, by providing the combination of a hollow cylindrical support for a parabolic reflector and which also is made of a material that conducts electricity well and is provided with slots of such shape and dimensions that each of these slots can be considered as a radiating element. Furthermore these slots are arranged in a configuration allowing an almost complete transfer of energy from the inside to the outside of the support wall.

Thus the conductive reflector support according to this invention is passive and the wave propagation direction inside the wall is at right angles to the wall.

BRIEF DESCRIPTION OF THE VIEWS

The above mentioned and other features, objects and advantages, and a manner of obtaining them are described more specifically below by reference to an embodiment of this invention shown in the accompanying drawings, wherein.

Figure 1:
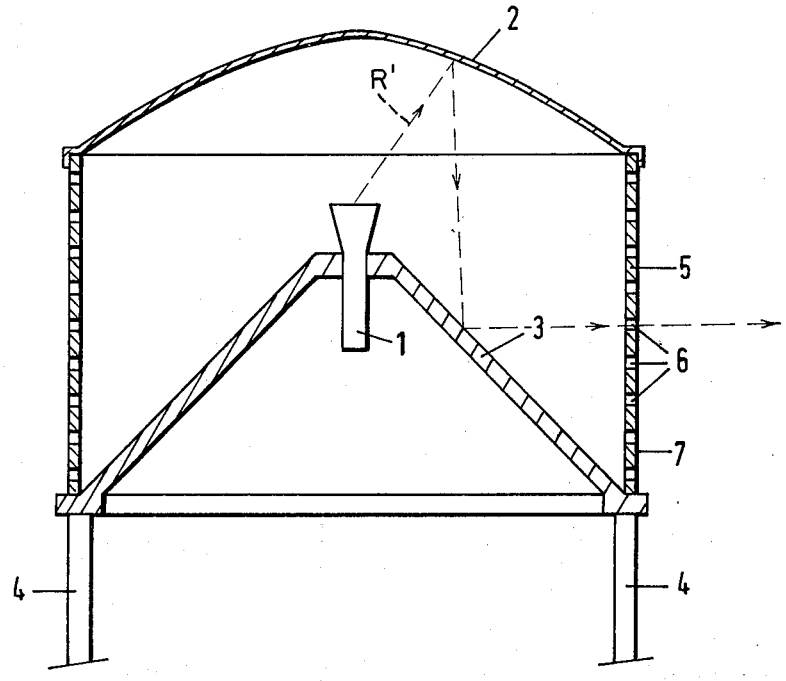
FIG. 1 shows a vertical section of an omnidirectional antenna having an overhead parabolic reflector supported by a wall according to a preferred embodiment of this invention.
Figure 2:
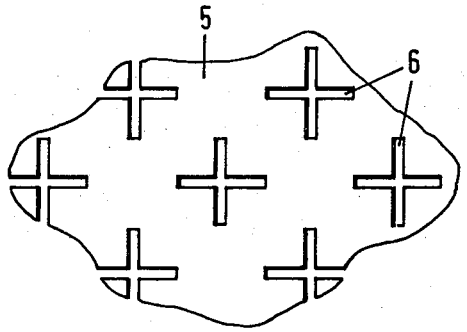
FIG. 2 shows a detail of a possible configuration of slots in the support wall shown in FIG. 1.

In FIG. 1 the antenna feed 1 is formed by a radiating waveguide having a circular cross-section, in which an EO1 mode is generated to obtain a vertically polarized radiation field or an HO1 mode to obtain a horizontally polarized radiation field. The antenna feed throws the transmitting energy on to a parabolic reflector 2, which casts the rays R′ striking it from many directions perpendicularly downward; the rays R′ strike a cone-shaped second reflector 3 mounted on a pedestal 4 and having a top angle of about 90°. After being reflected the rays R′ strike the cylindrical wall 5, which supports the reflector 2, almost at right angles. The wall 5 is provided with slots 6. A wave incident on the cylindrical wall will induce currents in it. With a suitable choice of the dimensions of the slots 6 all the energy incident on the surface round a slot 6 is concentrated in the slot itself. As to their direction the components of the fields in the slot exhibit the same relation as that of the incident wave, so that the energy is transmitted to the space outside the wall 5.

Figure 3:
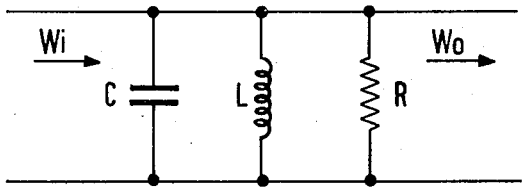
FIG. 3 is an electrical representation of a slot in the support wall shown in FIGS. 1 and 2.

The slot 6 can be represented as a parallel circuit consisting of an inductor L, a capacitor C and a resistor R (FIG. 3). The resistance value of R is very large and depends, among other things, on the conductivity of the wall material and on the ratio of the slot width to the thickness of the wall 5. In practice the resistance value of R proves to be high with a good conductivity of the wall.

Form and dimensions of the slots 6, and correspondingly, the L and C values of the circuit dependent on them, are determined by the frequency range of the antenna. Moreover, by changing the shape of the slots 6, it is possible to obtain a different transmission characteristic e.g. one for the largest possible bandwidth.

If the resistance value of R is very large, the output energy $W_0$ radiated by the slot will be almost equal to the input energy $W_1$ radiated into it. When a suitable configuration of slots has been provided, almost all the energy radiated on to the wall 5 can be transmitted. Because the slots 6, which act as discrete radiators, are placed closely together, the radiation diagram will be rotation-symmetric in the horizontal plane. In the vertical plane a change in the radiation diagram will only occur at large angles with respect to the horizontal. For covering an area round the antenna, however, the range of angles up to 10° in the radiation diagram is the most important range.

The wall thickness of the support 5 is so chosen as to give sufficient rigidity on the one hand and to ensure optimum radiation characteristics on the other.

In order to protect the radiating parts and the antenna feed 1 from the influence of the weather, a non-conducting foil 7 can be spread or wrapped around the support 6. As this foil 7 has no supporting function, the material of which it is made need not meet high mechanical requirements, so that its electrical properties can be considered first its most important characteristic.

While there is described above the principles of this invention in connection with specific apparatus, it is to be clearly understood that this description is made only by way of example and not as a limitation to the scope of this invention.

What is claimed is:

1. In an omnidirectional micro-wave antenna comprising:

A. a parabolic reflector,

B. a feed means at the focus of said parabolic reflector,

C. a conical reflector coaxial with and spaced from said parabolic reflector for reflecting the parallel rays from said parabolic reflector radially omnidirectionally, said feed means mounted in the vicinity of the apex of said conical reflector, the improvement comprising:

D. a passive cylindrical support for said parabolic reflector surrounding said control reflector and coaxial therewith, said support comprising an electrically conductive material containing slots for the transfer of energy radially from the inside to the outside of said support.

2. An antenna according to claim 1 wherein said feed means is a radiating waveguide.

3. An antenna according to claim 1 wherein said feed means is supported by said conical reflector.

4. An antenna according to claim 1 including means for supporting said conical reflector.

5. An antenna according to claim 1 wherein the axis of said reflectors and support is vertical and the omnidirectional radial pattern of said rays is horizontal.

6. An antenna according to claim 1 including a nonconductive foil surrounding said support to protect said reflectors and feed means from the weather.

* * * * *

CERTIFICATE OF CORRECTION

Patent No. 3,978,486 Dated August 31, 1976

Inventor(s) Michiel Antonius REINDERS

It is certified that error appears in the above-identified patent and that said Letters Patent are hereby corrected as shown below:

Page 1, after Item 76, insert - - [73] Assignee: De Staat der Nederlanden, te Dezen Vertegenwoordigd Door de Directeur-Generaal der Posterijen, Telegrafie en Telefonie, The Hague, The Netherlands - -

Column 1, line 7, change "of" to - - on - - ; line 15, change "dielectic" to - - dielectric - - ; line 28, change "difficulty" to - - difficultly - - ; line 30, change "increased" to - - increases - - ;

Column 2, line 59, cancel "first"

Column 3, line 12, change "control" to - - conical - -

Signed and Sealed this

First Day of March 1977

[SEAL]

*Attest:*

RUTH C. MASON
*Attesting Officer*

C. MARSHALL DANN
*Commissioner of Patents and Trademarks*